US006381755B2

(12) United States Patent
Cortani

(10) Patent No.: US 6,381,755 B2
(45) Date of Patent: May 7, 2002

(54) NOTCHED TOE PANTY HOSE AND METHOD OF USE

(76) Inventor: Karyn J. Cortani, 416 W. Stocker St., Apt. E, Glendale, CA (US) 91202

( * ) Notice: Subject to any disclaimer, the term of this patent is extended or adjusted under 35 U.S.C. 154(b) by 0 days.

(21) Appl. No.: 09/841,778

(22) Filed: Apr. 24, 2001

Related U.S. Application Data

(60) Provisional application No. 60/199,595, filed on Apr. 25, 2000.

(51) Int. Cl.[7] ..... A41B 11/00
(52) U.S. Cl. ..... 2/239
(58) Field of Search ..... 2/239, 240, 241, 2/242, 409

(56) References Cited

U.S. PATENT DOCUMENTS 366,503 A * 7/1887 O'Neill
482,095 A * 9/1892 McClurg
1,314,356 A * 8/1919 Nordblad
1,452,302 A * 4/1923 Loven
D126,528 S * 4/1941 Greenwald
2,332,252 A * 10/1943 Payne ..... 36/2.5
2,422,736 A * 6/1947 Lambert ..... 2/241
2,932,829 A * 4/1960 Corbin ..... 2/239
3,128,763 A * 4/1964 Langenfeld et al. ..... 128/153
4,181,982 A * 1/1980 Segovia ..... 2/239
6,000,247 A * 12/1999 Takeda et al. ..... 66/187

* cited by examiner

*Primary Examiner*—John J. Calvert
*Assistant Examiner*—Alissa L. Hoey
(74) *Attorney, Agent, or Firm*—Timothy Thut Tyson; Ted Masters

(57) ABSTRACT

Elastic panty hose are modified to have a shallow notch in the toe portion for accepting the thong of a thong style sandal or shoe. When the foot and panty hose are inserted into the thong style sandal or shoe, the notch is stretched thereby smoothing the contour of the panty hose around the toes.

3 Claims, 6 Drawing Sheets

NOTCHED TOE PANTY HOSE AND METHOD OF USE

CROSS REFERENCE TO RELATED APPLICATION

This application claims the filing benefit under 35 U.S.C. §119(e) of U.S. Provisional Application No. 60/199,595 filed Apr. 25, 2000, which is included herein by reference.

TECHNICAL FIELD

The present invention pertains generally to panty hose garments, and more particularly to panty hose having notches between the big toes and the second toes allowing them to be worn with thong style footwear.

BACKGROUND ART

Thong style footwear such as sandals and "flip flops" are well known in the art. Such footwear has a strap or thong which passes between the big toe and the second toe, and two or more connecting straps which pass over the top of the foot. Such footwear is most conveniently worn when barefooted so that the thong may freely enter and engage the cleft between the toes.

Tabi socks from Japan are specifically designed with gaps between the big toe and the second toe so they may be worn with getas which are wooden clogs having thongs passing between the positions of the big toes and the second toes. The gaps are as long as the clefts between the toes allowing the thongs to be positioned in the crotches of the clefts without tugging on the tabi socks and toes. The tabi socks are made of a relatively thick material such as cotton and are knitted and sewn to conform to the curvatures of the toes to maintain a smooth appearance.

Novelty socks are also available having each toe knitted and sewn separately in the rounded shapes of the toes in the same manner as gloves.

U.S. Pat. No. 6,000,247 shows hosiery having a foot portion similar to tabi socks with a separate big toe section.

Thong type sandals and shoes have become increasingly popular with the trend toward casual dress. But the use of tabi socks with them is limited because the impression is too casual. And wearing thong type sandals and shoes barefoot has limited appeal.

Regular panty hose create a much more dressy appearance and are worn for several reasons with shoes. Shoes tend to be uncomfortable without hose or socks because there are seams inside and the shoe materials are rough. Hose or socks provide padding between the skin of the feet and the shoes. Shoes are also uncomfortable without hose or socks because the feet sweat causing the skin to stick to the shoe material. Hose or socks wick the moisture away making the shoes more comfortable. Panty hose are also desirable because they make the legs look better by hiding blemishes and creating a slick appearance. In addition, they provide some warmth.

But regular panty hose have limited utility with thong type sandals and shoes. The stretching of the hose material around the thongs uncomfortably pulls the toes and bunches up around the thongs. It would be desirable to have panty hose specially designed for use with thongs.

DISCLOSURE OF INVENTION

The present invention is directed to nylon or polyester panty hose having notches between the big toes and second toes to accept thong style footwear. The notches are relatively shallow so that when the feet of the wearer are inserted into the foot portions and the feet pushed against the thongs, the elastic material around the notches stretches to conform to the thongs and toes creating a smooth appearance making the panty hose virtually invisible.

In accordance with an important aspect of the invention, the notch is shaped and dimensioned such that it has a depth which is less that the length of the cleft between the toes, so that when the foot and toe portion are inserted into the thong style footwear, the notch must elastically stretch to permit the thong to abut the crotch of the cleft. In so doing, the fabric of the toe portion of the panty hose is drawn taught around the toes thereby giving the toe portion a smooth surface and appearance.

In accordance with an important feature of the invention, the edges of the notch and the end of the hose are substantially 90° with respect to each other allowing easy fabrication. The stretching of the elastic material conforms the hose to the adjacent toes.

In accordance with yet another feature of the invention, the edges of the notch are substantially 90° with respect to each other allowing easy fabrication. The stretching of the elastic material conforms the hose to the adjacent toes.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
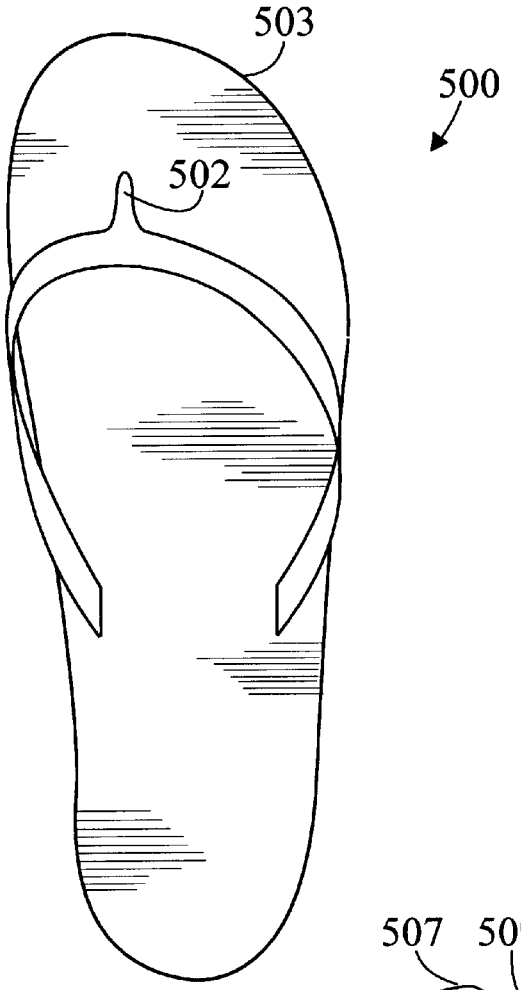
Fig. 1 PRIOR ART
FIG. 1 is a top plan view of prior art thong style footwear.
Figure 2:
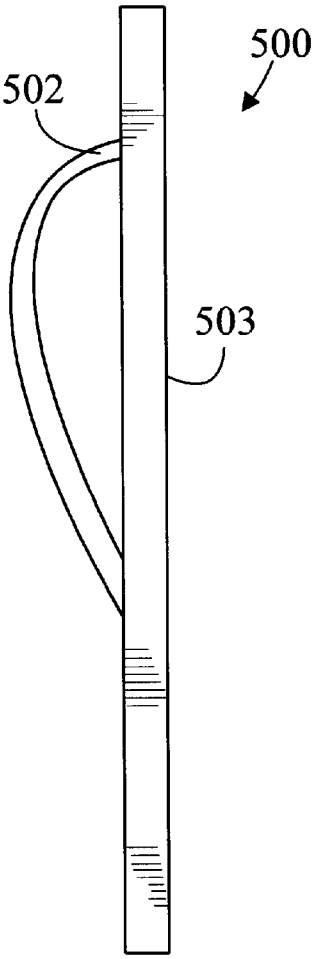
Fig. 2 PRIOR ART
FIG. 2 is a side elevation view of the prior art thong style footwear.
Figure 3:
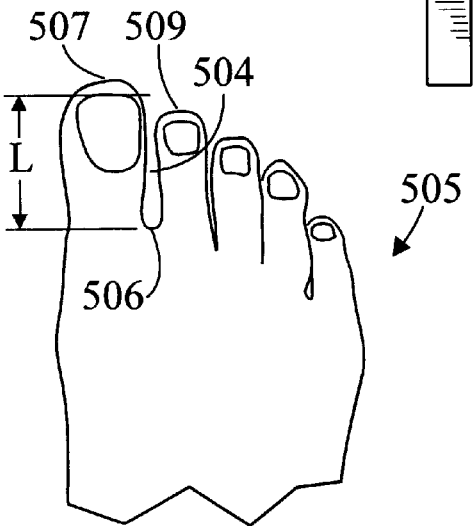
FIG. 3 is a fragmented top plan view of a human foot.

Referring initially to FIGS. 1 and 2, there are illustrated a top plan view and a side elevation view of prior art thong style footwear 500. FIG. 3 is a fragmented top plan view of a human foot 505. Footwear 500 includes a thong 502 which is attached to a sole 503. The thong is positioned and designed to enter the cleft 504 between the big toe 507 and second toe 509 of foot 505 of a wearer. When installed upon the foot 505 of the wearer, thong 502 resides in the crotch 506 of cleft 504. Cleft 504 has a length L which is measured from crotch 506 to midway between the end of the big toe 507 and the end of second toe 509.

Figure 4:
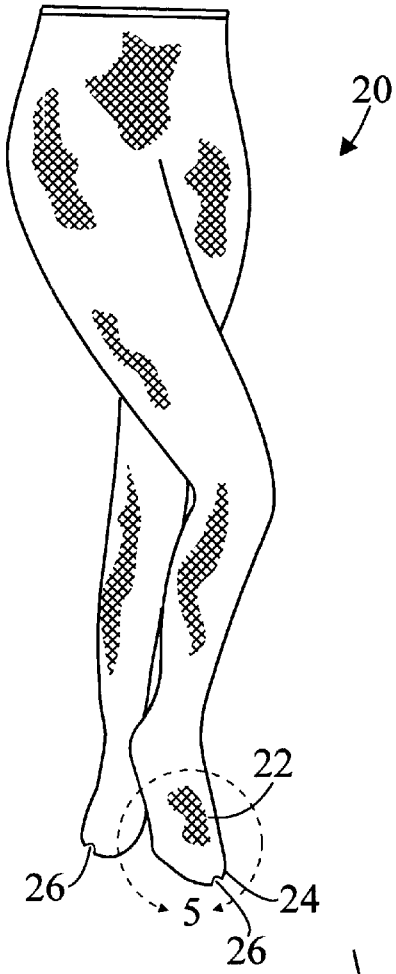
FIG. 4 is a reduced perspective view of notched toe panty hose in accordance with the present invention.

FIG. 4 illustrates a reduced perspective view of notched toe panty hose in accordance with the present invention, generally designated as 20. Panty hose 20 are constructed from elastic fabrics such as nylon or polyester that are well known in the art. Each leg has a foot 22 having a toe portion 24. Each toe portion 24 has a notch 26.

Figure 5:
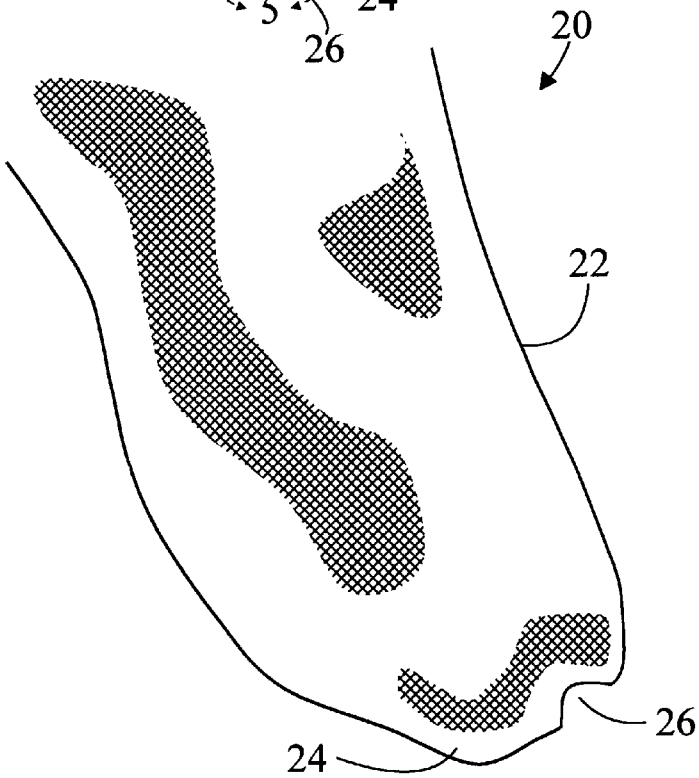
FIG. 5 is an enlarged view of the area 5 of FIG. 4.

FIG. 5 is an enlarged view of the area 5 of FIG. 4. When the panty hose of the present invention are put on, they tend to look like FIG. 5 because the elastic material only has stretched to fit the general foot and not the big toe and the other toes.

Figure 6:
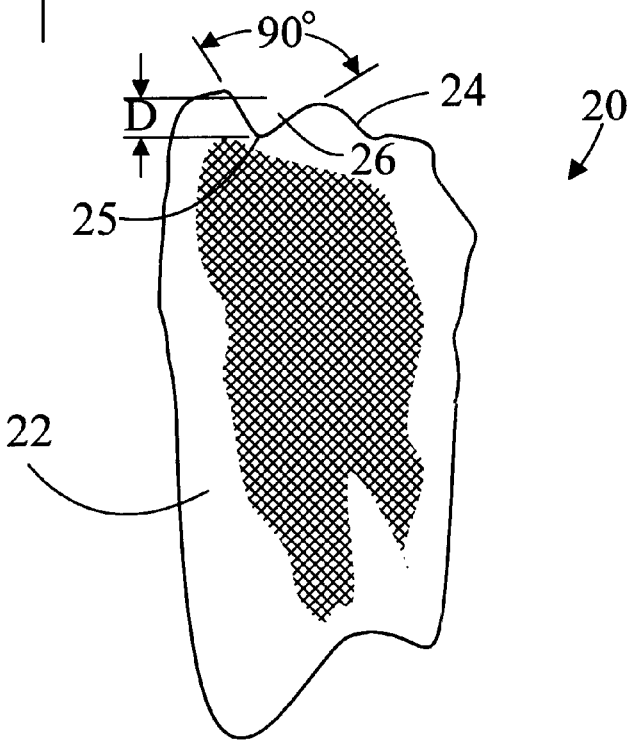
FIG. 6 is a fragmented top plan view of the foot of the notched toe panty hose.

FIG. 6 is a fragmented top plan view of the foot 22 of notched toe panty hose 20 before it is placed on a human foot 505. It is noted that notch 26 has sides which form an angle of about 90° with respect to each other. The actual angle or profile can vary widely because the elasticity of the fabric will allow a perfect fit when the panty hose is put on. It is also noted that notch 26 has a depth D which is less than the length L of the cleft (refer to FIG. 3). Depth D is measured from the bottom 25 of notch 26 to midway between the ends of toe portion 24 which receive the big toe and second toe of the wearer.

Figure 7:
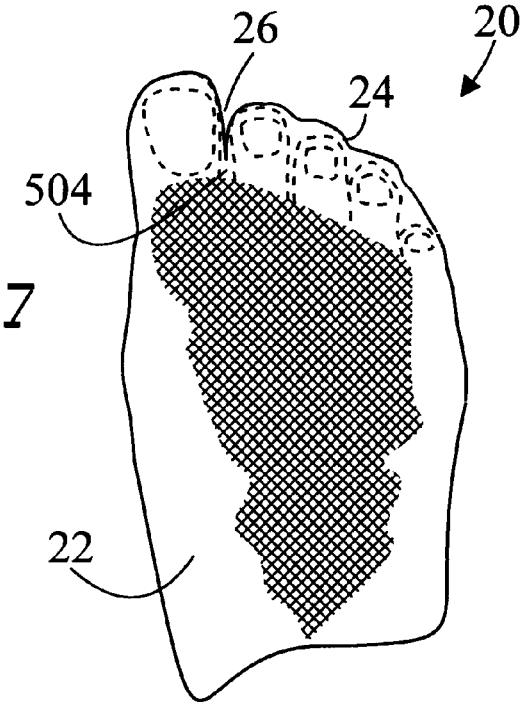
FIG. 7 is a fragmented top plan view of the notched toe panty hose placed on the human foot.

FIG. 7 is a fragmented top plan view of notched toe panty hose 20 placed on the human foot 505. It is noted that notch 26 is disposed on toe portion 24 such that when the foot 505 of the wearer is placed into toe portion 24, notch 26 aligns with cleft 504. In a preferred embodiment, depth D of notch 26 is about ¾ of an inch, which is about half the length L of cleft 504.

Figure 8:
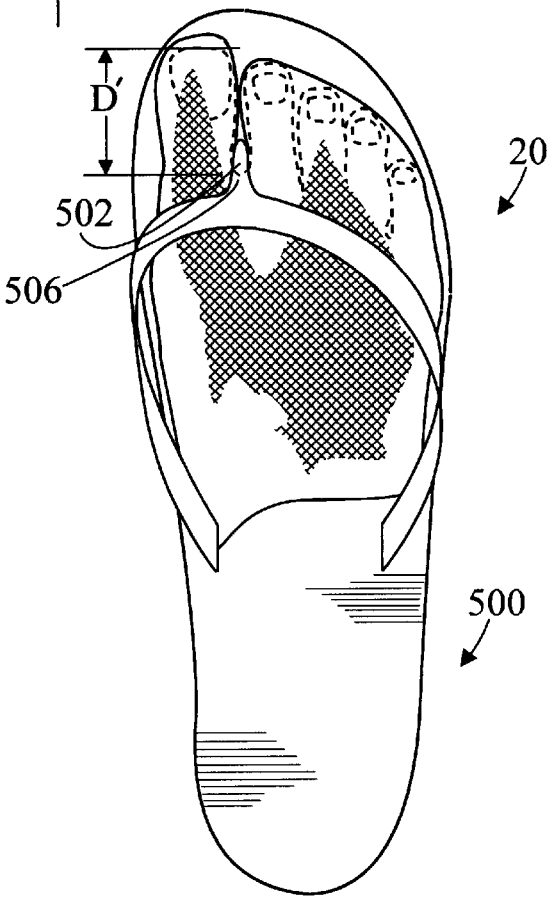
FIG. 8 is a fragmented top plan view of the foot and panty hose inserted into thong style footwear.

FIG. 8 is a fragmented top plan view of the human foot 505 and foot portion 22 of panty hose 20 inserted into thong style footwear 500. When the human foot 505 and toe portion 24 are inserted into thong style footwear 500, notch 26 elastically stretches to greater depth D' which extends to crotch 506 when the thong 502 abuts the crotch 506 of cleft 504. That is, stretched depth D' of notch 26 is equal to length L of cleft 504.

Figure 9:
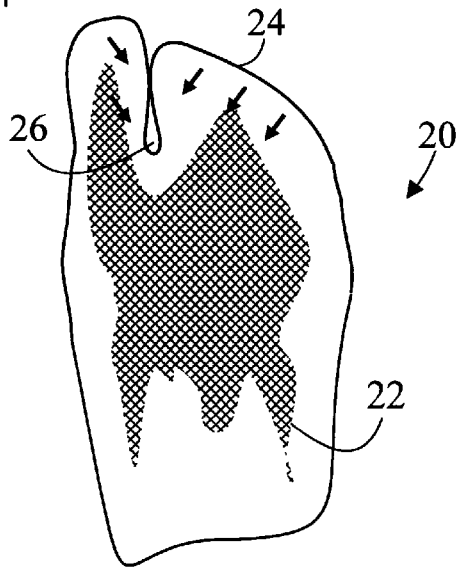
FIG. 9 is a fragmented top plan view of the panty hose only of FIG. 8.

FIG. 9 is a fragmented top plan view of the panty hose 20 only of FIG. 8. Because notch 26 must stretch to allow thong 502 to abut crotch 506 of cleft 504, the toe portion 24 of foot 22 is drawn tight around the toes of the wearer as is shown by the arrows in the figure. This gives the toe portion 24 a smooth surface as opposed to a wrinkled surface that would occur if notch 26 were as deep as cleft 504 so that no stretching would take place.

Figure 10:
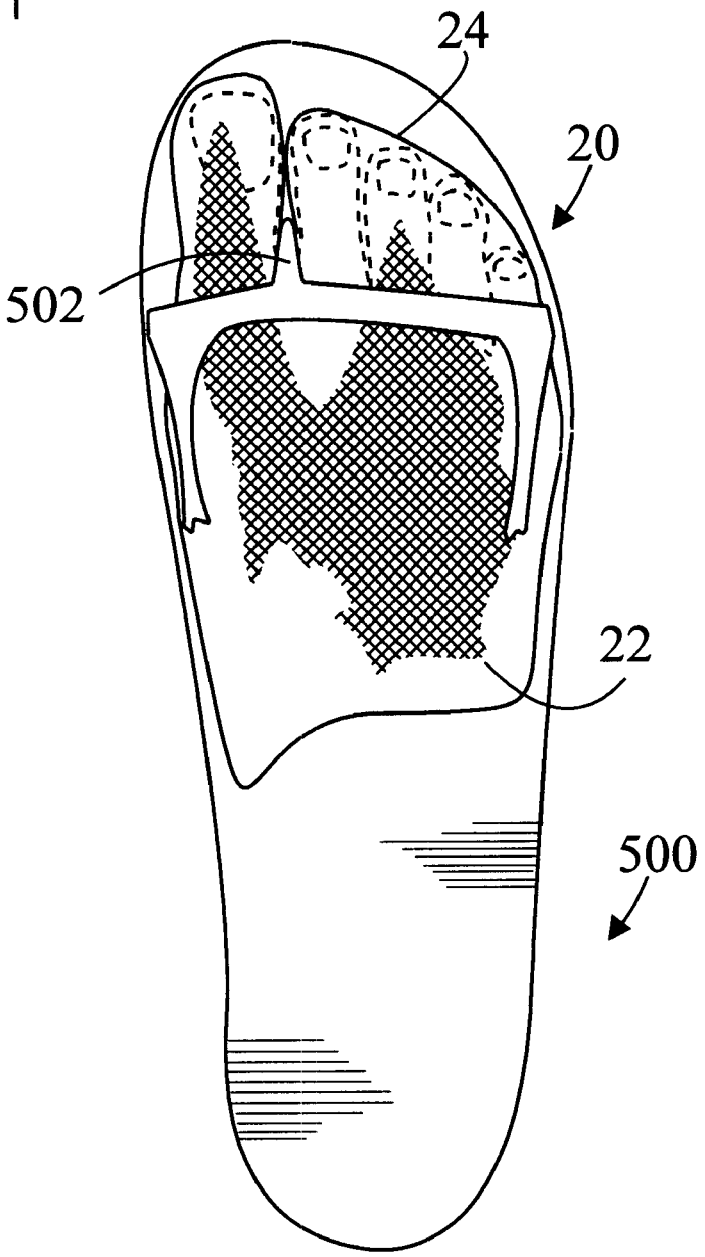
FIG. 10 is a fragmented top plan view of the foot and panty hose inserted into a different thong style footwear; and, FIG. 11 is an enlarged plan view of the end of the foot portion turned inside out.

FIG. 10 is a fragmented top plan view of the foot and panty hose inserted into a different thong style footwear.

Figure 11:
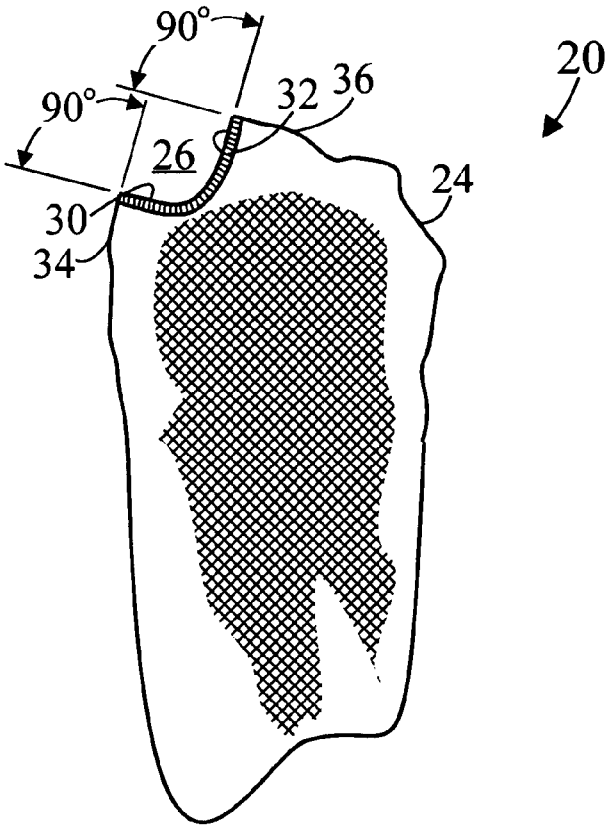

FIG. 11 is an enlarged plan view of the end of the toe portion 24 turned inside out. Because the material of the panty hose is elastic, exact forming of the toe ends to the curvatures of the toes is not necessary as is required in tabi socks and other socks where thicker cotton materials are used. The relationship of the sides 30, 32 of the notch 26 to the ends 34, 36 of the toe portion 24 adjacent the sides may be substantially 90°, i.e., side 30 to end 34 and side 32 to end 36, as shown allowing for maximum ease of fabrication.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. Panty hose for use with thong style footwear by a wearer having a foot having toes, wherein the thong style footwear has a thong which enters the cleft between the big and second toe of the foot of a wearer and resides in the crotch of the cleft, the cleft having a length, said panty hose comprising:

said panty hose being constructed from elastic fabric and having two foot portions;

each foot portion having a closed toe portion;

each said toe portion having a notch between the location for the big toe and the location of the remaining toes such that when the foot of the wearer is placed into said toe portion said notch aligns with the cleft;

each said notch having a depth less than the length of the cleft so that when the foot of a wearer is placed inside said toe portion and said toe portion is inserted into the thong style footwear, said notch elastically stretches when the thong abuts the crotch of the cleft, so that said toe portion is drawn tightly around the toes of the wearer to form a smooth surface; and, wherein said depth of said notch is about half of the length of the cleft.

2. Panty hose according to claim 1, wherein said depth of said notch is about ¾ of an inch.

3. A method for wearing panty hose with a thong so that the toe portion of the panty hose presents a smooth surface, comprising:

providing a wearer having a foot having toes, a cleft disposed between a big and second toe, said crotch having a cleft, said cleft having a length;

providing thong style footwear having a thong which is shaped and dimensioned to reside in said crotch of said cleft of said foot of said wearer;

providing panty hose specifically designed for use with said thong style footwear, said panty hose being constructed from elastic fabric and having two foot portions, each said foot portion having a closed toe portion, each said toe portion having a notch between the location for the big toe and the location of the remaining toes, each said notch having a depth which is about half of said length of said cleft;

said wearer placing said foot into said toe portion so that said notch aligns with said cleft;

said wearer inserting said foot and said toe portion into said thong style footwear, so that said notch elastically stretches when said thong abuts said crotch of said cleft; and, observing that said toe portion stretches over said toes of said wearer thereby presenting a smooth surface.

* * * * *